US005755324A

United States Patent [19]

Campbell

[11] Patent Number: 5,755,324

[45] Date of Patent: May 26, 1998

[54] SEPARATING ARRANGEMENT FOR CANS

[75] Inventor: Geoffrey Campbell, Kingswood, United Kingdom

[73] Assignee: Riverwood International Corporation, Atlanta, Ga.

[21] Appl. No.: 793,145

[22] PCT Filed: Aug. 9, 1995

[86] PCT No.: PCT/GB95/01877

§ 371 Date: Apr. 25, 1997

§ 102(e) Date: Apr. 25, 1997

[87] PCT Pub. No.: WO96/05121

PCT Pub. Date: Feb. 22, 1996

[30] Foreign Application Priority Data

Aug. 17, 1994 [GB] United Kingdom ..... 9416623

[51] Int. Cl.[6] ..... B65D 75/00

[52] U.S. Cl. ..... 206/430; 206/427; 53/445; 53/447

[58] Field of Search ..... 206/427, 430, 206/821; 53/445, 447

[56] References Cited

U.S. PATENT DOCUMENTS

| | | | |
|---|---|---|---|
| 3,351,264 | 11/1967 | Bostrom | 229/42 |
| 4,593,818 | 6/1986 | Schenkman | 206/821 |
| 5,437,143 | 8/1995 | Culpepper et al. | 53/445 |
| 5,687,847 | 11/1997 | Culpepper et al. | 206/430 |

FOREIGN PATENT DOCUMENTS

| | | | |
|---|---|---|---|
| 0227559 | 11/1986 | European Pat. Off. | B65D 71/00 |
| 0595602 | 5/1994 | European Pat. Off. | B65D 71/70 |
| 9114604 | 11/1992 | Germany | B65D 71/72 |
| WO 94/08868 | 4/1994 | WIPO | B65D 65/00 |

*Primary Examiner*—David T. Fidei
*Attorney, Agent, or Firm*—Isaf, Vaughan & Kerr

[57] ABSTRACT

A paperboard separating sheet (10) for separating two stacked layers of cans (11, 12) is disclosed. The sheet has a plurality of can receiving locations (13), each location having an inner opening (23) and an outer opening (24), respectively, each one of the openings being defined by a series of cuts (23, 24), respectively, in the paperboard sheet. The cuts define first, second, and third covering portions (20, 21, 22), respectively, which are joined together by a plurality of tabs (25, 26), respectively, which allow the respective covering portions to move into different planes relative to one another when the separating sheet is sandwiched between two stacked cans. In use, the third portion of the separating sheets rests on a top rim of a lower can (11), the second portion of the paperboard sheet sits between the top rim of the can and a recessed panel in which a can opening device is formed, and the first portion of the paperboard sheet covers the can opening device. So constructed, the paperboard sheet allows an upper can to rest upon a lower can without metal-to-metal contact between the cans.

12 Claims, 4 Drawing Sheets

SEPARATING ARRANGEMENT FOR CANS

FIELD OF THE INVENTION

This invention relates to arrangements for separating a plurality of food or beverage cans.

BACKGROUND OF THE INVENTION

The use of cans for storing drinks, foodstuffs and other materials is well known. These cans are oftentimes stacked one above the other with the base of an upper can received on the top of a lower can. Such metal to metal contact is, however, undesirable during storage and distribution prior to use by the end consumer. A current trend in multiple packaging is for multipacks containing two or more layers of cans stacked on top of each other. These layers may require separation for the reasons discussed above.

SUMMARY OF THE INVENTION

According to the present invention there is provided an arrangement for separating a pair of cans stacked one on top of the other. Each can has a base rim and a top rim projecting above a top panel incorporating a can opening device. The separating arrangement includes a paperboard member having a pair of concentric openings disposed one within the other, with a first opening being dimensioned so as to be marginally smaller than the top rim of the lower can and a second opening being dimensioned so as to span the can opening device formed in the top panel of the can, said second opening defining a first cover portion for the can opening device. A second cover portion is defined in the separating sheet between the first and second openings, and a third cover portion being defined externally of the first opening, said first cover portion being connected to the second cover portion by at least one first interconnecting tab, and the second cover portion being connected to the third cover portion by at least one second interconnecting tab, the said interconnecting tabs being constructed and arranged to allow the cover portions to move into different planes relative to each other.

Preferably the tabs are formed integrally with the cover portions as a part of the paperboard or separating sheet member. Conveniently the paperboard member will provide a plurality of pairs of first and second openings for separating a plurality of stacked pairs of cans. Most cans are generally circular in section and so for such cans the openings in the paperboard member are generally circular. It is a preferred feature that there are at least three tabs connecting each pair of cover portions. Preferably there are four tabs generally equispaced around the periphery of each such opening. In a preferred arrangement the inner tabs are located at points which generally bisect the locations of the outer tabs of the arrangement.

In preferred embodiments, each opening is formed by a plurality of separate cuts in the paperboard member, the number of cuts corresponding to the number of tabs spanning the opening. Ideally the majority of each cut lies on the desired general periphery of the opening with one end of each cut extending outwardly and the other end of each cut extending inwardly of the cut, the outer end of one cut overlapping and being spaced from the inner end of an adjacent cut so as to define one of the tabs.

Conveniently the paperboard member is also provided with at least one recess for engagement with suitable indexing and positioning mechanisms in a packing line.

Embodiments of the invention are described in more detail below.

DETAILED DESCRIPTION OF THE PREFERRED EMBODIMENT

The figures show a can separating sheet 10, which in this embodiment is made from paperboard.

Figure 1:
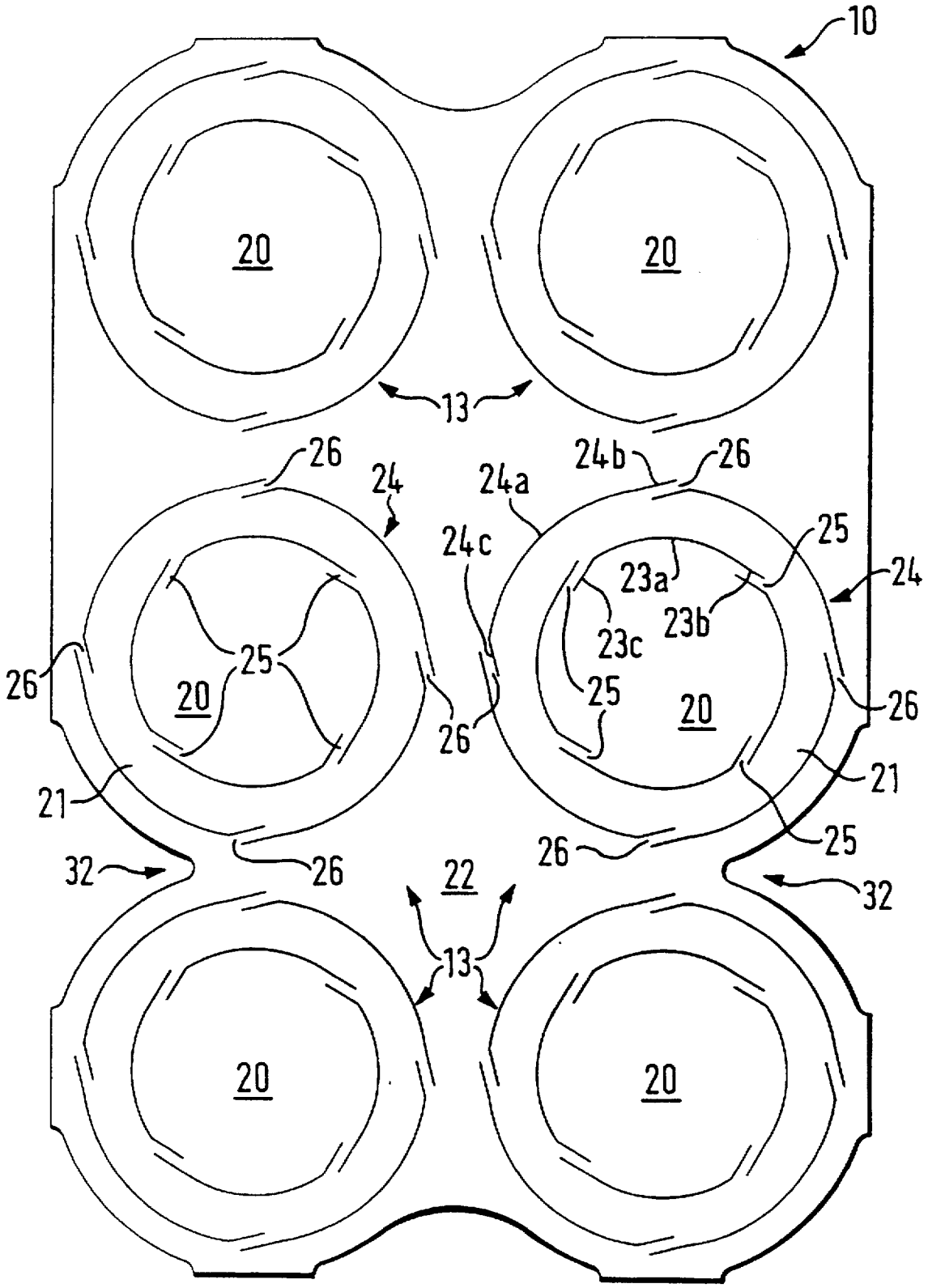
FIG. 1 is a plan view of a can separating arrangement according to the present invention.

Other materials however, may be used to fabricate sheet 10. The sheet 10 is, in use, positioned between an array of upper cans 11 and lower cans 12, with a pair of upper and lower cans (FIG. 3) being provided for each can receiving location 13 of the sheet 10. In FIG. 1, there are six such locations 13.

The sheet 10 shown in the figures is designed particularly for cans 11, 12 having a base rim 14 disposed inwardly of a side wall 15, a top rim 16 also disposed inwardly of the side wall 15, a top panel 17 below the top rim and a can opening means 18 such as a ring pull in the top panel 17.

Quite often such cans 11, 12 are stacked one on top of the other with the base rim 14 of the upper can 11 nesting in the top rim 16 of the lower can 12. In such a stacked arrangement there is generally metal to metal contact between the bottom edge of the base rim 14 and the top panel 17, and between the top rim 16 and the side of the base rim 14. After the cans are filled with a beverage, for example, such metal to metal contact is undesirable and in some cases can result in an unpleasant residue in the region of the metal to metal contact due to movement abrasion.

Because each location 13 is the same as the others on the sheet 10, only one is described in detail hereinbelow. Location 13 comprises a first cover portion 20 which in use covers the opening means 18 of the lower can, a second cover portion 21 which in use covers a part of the top panel 17 around the opening means 18 and a third cover portion 22 which in use covers the top rim 16 of the lower can. The third cover portion 22 extends outwards and is continuous with the corresponding third cover portions associated with the other locations 13 of the separating sheet 10.

The cover portions 20, 21, 22 are generally defined by inner and outer openings 23; 24 which are generally of a circular nature. Each opening is formed from four cuts 23*a*; 24*a*. The central part of each cut is part-circular. One end of each cut, the most clockwise end, is angled outwards 23*b*; 24*b* and the other end is angled inwards 23*c*; 24*c*. The ends of adjacent cuts overlap and are spaced from each other to constitute inner tabs 25 and outer tabs 26.

These tabs 25, 26 connect the first and second cover portions and the second and third cover portions respectively. The tabs allow adjacent cover portions to take up different planes relative to each other.

Figure 2:
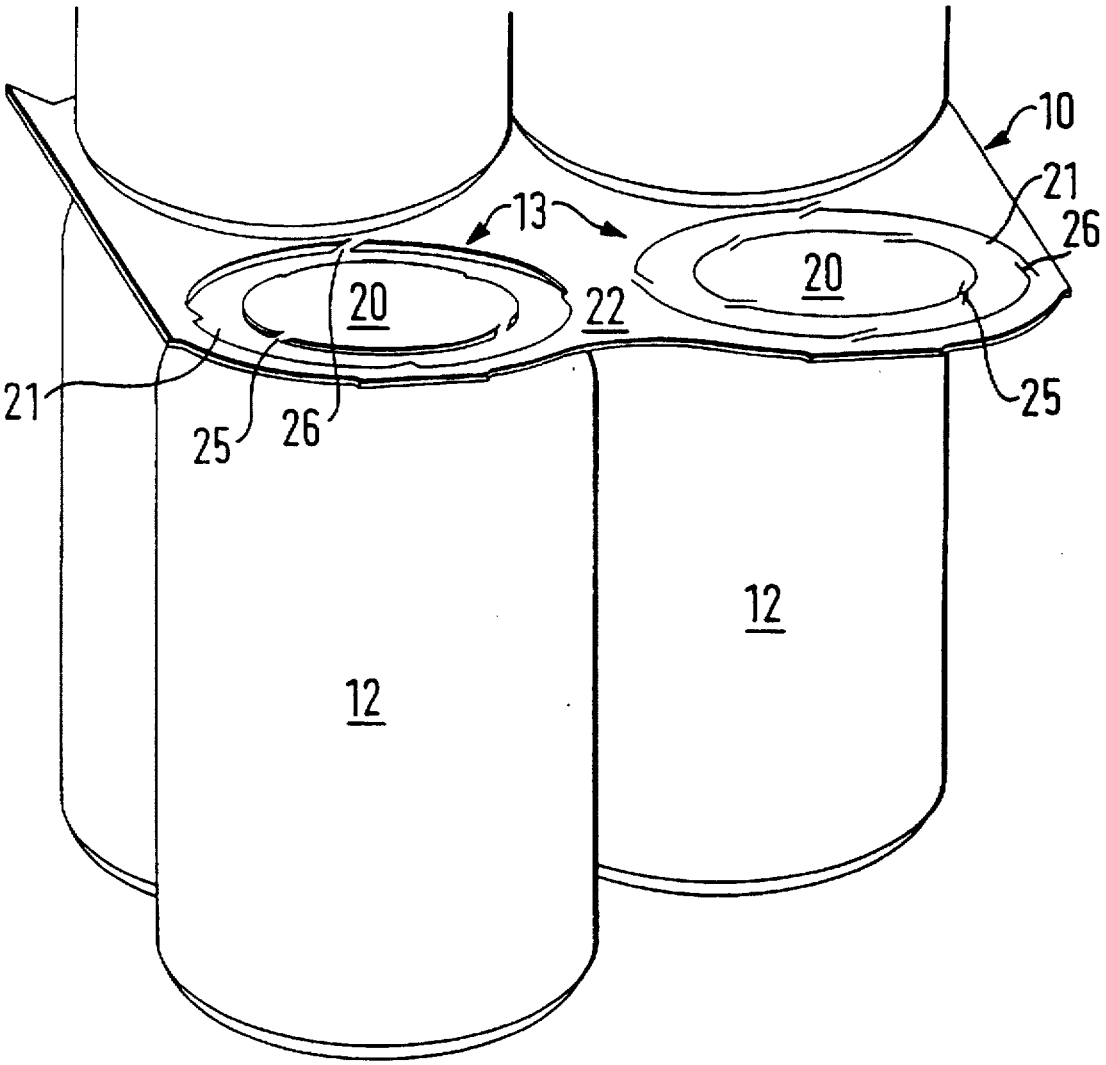
FIG. 2 is a perspective view of the arrangement in use with the top can of a pair of cans removed.
Figure 3:
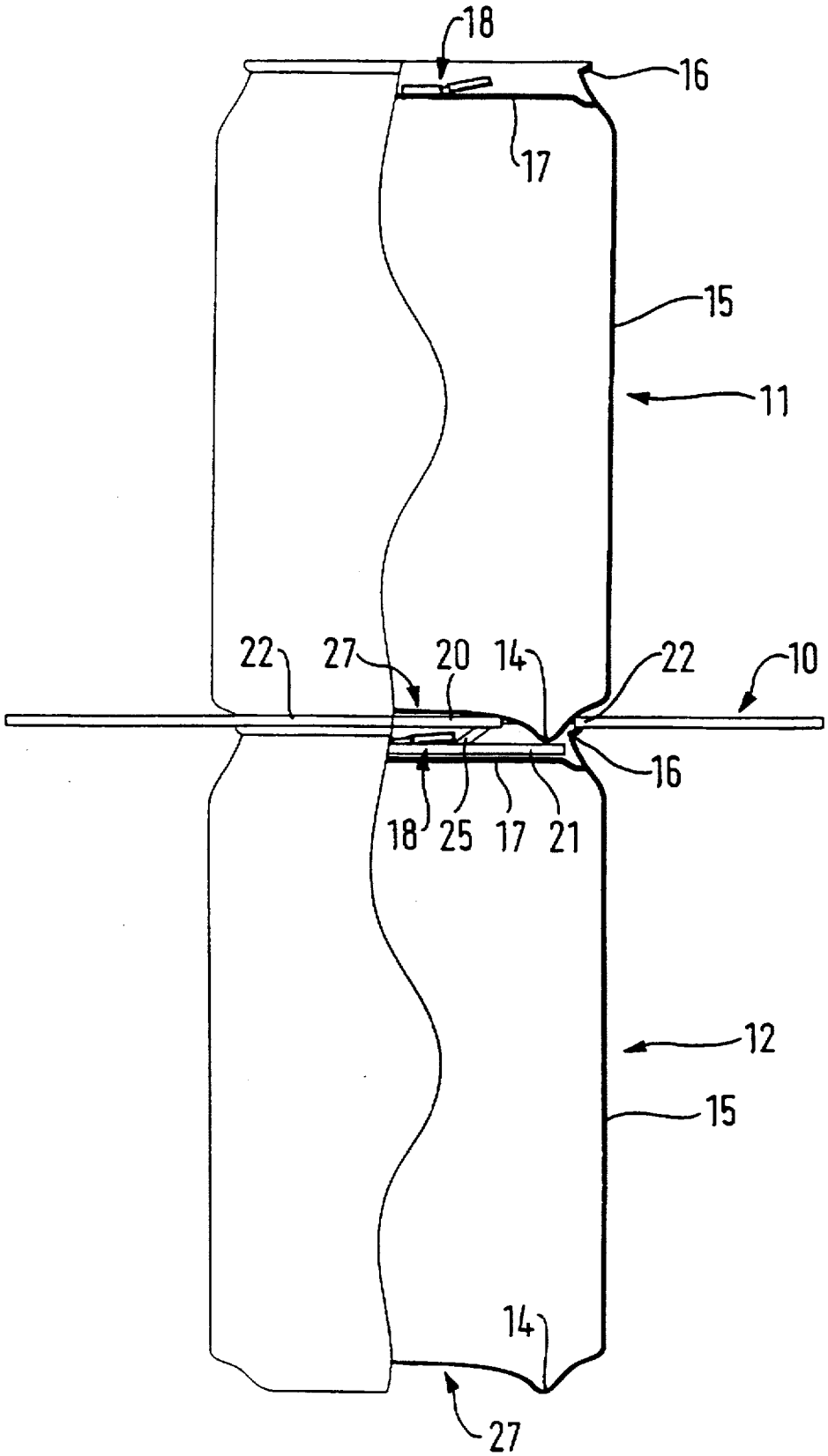
FIG. 3 is a partial cross-sectioned elevation view through a pair of cans separated by the arrangement of FIG. 1.

This movement also results in a slight rotation relative to each other. FIGS. 2 and 3 clearly show a lower can 12 with the separating sheet 10 positioned above. The third cover portion 22 sits on the top rim 16 of can 12 between the top rim 16 and the side portion of the base rim 14 of the upper can 11. The second cover portion 21 is moved into a lower position relative to the third portion by the downwardly projecting base rim 14 of the upper can 11. The first cover portion 20, however, is not directly engaged by the base rim 14, but is prevented from remaining in the same plane as the second cover portion 21 by the upwardly projecting opening means of the can 12. The first cover portion 20, therefore, remains in a plane above the second cover portion 21 and nestles in a hollow 27 formed in the underside of the upper can 11.

Such an arrangement prevents metal to metal contact while still continuing to allow the nesting of the cans.

Each can receiving location 13 can, of course, be dimensioned and indeed shaped according to the type of cans being used. It is also envisaged that further cover portions could be incorporated as a part of sheet 10 in a similar manner if it was necessary to accommodate further changes of plane in the separator sheet.

Also the precise number of tabs 25, 26 is a matter of design choice. Four inner tabs 25 and four outer tabs 26 has been found to be convenient, but any number is possible. In the embodiment shown the inner tabs 25 bisect the outer tabs which results in better separating sheet strength than if tabs 25 and 26 they were aligned with one another. However, strength may not always be important, and so the tabs could be aligned if desired. Also, the outer tabs may be located in sheet 10 such that they are not immediately adjacent the narrowest parts of the third cover portion.

Figure 4:
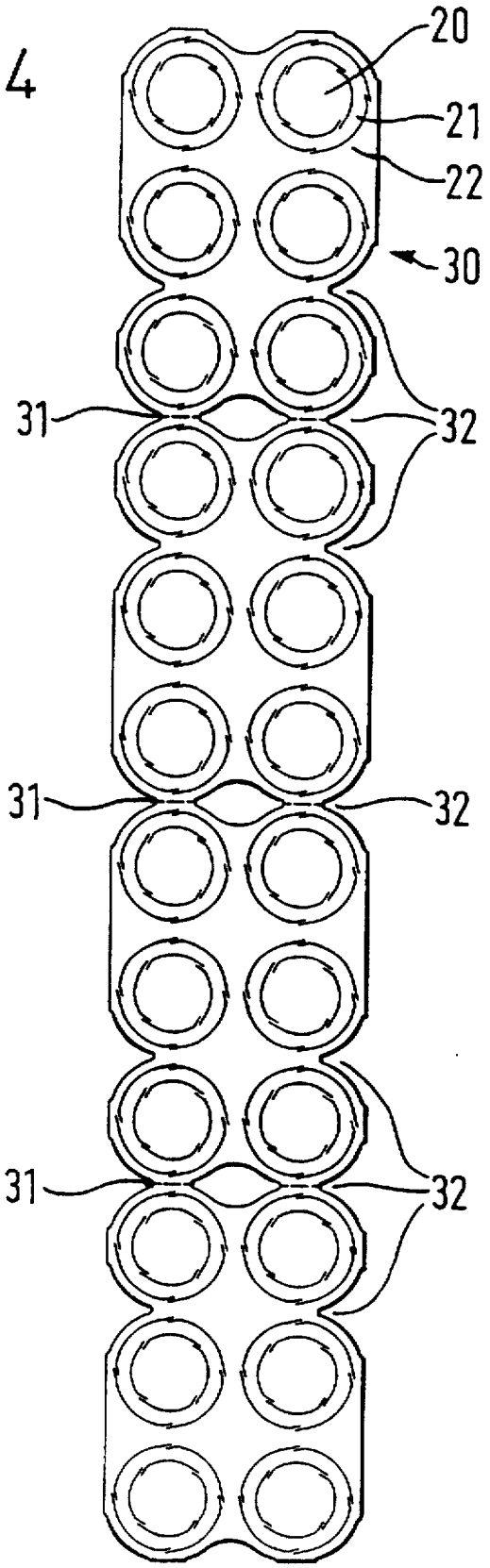
FIG. 4 shows a strip of connected separating arrangements.

As shown in FIG. 4, the separator sheet 10 could be provided in a 12×2 arrangement 30 for application to an array of 24 lower cans and 24 upper cans. Lines of weakening 31 could then be provided to divide the resulting array into more manageable units. Using large arrays such as this enables the sheet 10 feeder (not illustrated) to operate more slowly and accurately than if it had to feed 2×3 sheets 10 in a rapid manner. It will also be clear that recesses 32 are provided in the sheet 10 to improve feeding and indexing relative to the cans.

Although the embodiments described above show the second cover portion 21 in a position lower than the other two cover portions, it is envisaged in some arrangements that it may be required to have other arrangements such as the third portion being on the lowest plane, the second portion being on a higher plane and the first portion on an even higher plane.

Other combinations are of course possible. Also it is clear that other rectangular arrays of cans are possible, and the array need not even be rectangular depending on the particular packing requirements.

It is also possible to incorporate the separator sheet 10 with other features such as independent side sheets extending down the side walls of the lower cans. The tabs need not be integrally formed, but could be formed separately from the sheet 10 and adhesively secured thereto.

While a preferred embodiment of the invention has been disclosed in the foregoing specification, it is understood by those skilled in the art that variations and modifications thereof can be made without departing from the spirit and scope of the invention, as set forth in the following claims. Moreover, the corresponding structures, materials, acts, and equivalents of all means or step plus function elements in the claims are intended to include any structure, material, or acts for performing the functions in combination with other claimed elements, as specifically claimed herein.

I claim:

1. An arrangement for separating a pair of cans stacked one on top of the other, the pair of cans having a lower can and a stacked upper can each can having a base rim and a spaced top rim projecting above a top panel of the can, the top panel incorporating a can opening device formed as a part thereof, said arrangement comprising a paperboard member for being positioned between the lower can and the upper can, said paperboard member having a pair of concentric openings defined therein;

said pair of openings comprising a first outer opening dimensioned so as to be marginally smaller than the top rim of the lower can and a second inner opening dimensioned so as to span the can opening device in the top panel of the lower can;

said second opening defining a first cover portion in said paperboard member for extending over the can opening device of the lower can;

a second cover portion being defined in said paperboard member between said first and said second openings; and a third cover portion defined by said paperboard member and extending away from the periphery of said first opening;

wherein said first cover portion is connected to said second cover portion by at least one first interconnecting tab and said second cover portion is connected to said third cover portion by at least one second interconnecting tab, said at least one first and second interconnecting tabs being constructed and arranged to allow said cover portions to move into different planes with respect to one another.

2. The arrangement as claimed in claim 1, wherein said at least one first and second interconnecting tabs are each formed integrally as a part of said paperboard member.

3. The arrangement as claimed in claim 2, wherein there are at least three of said first interconnecting tabs connecting said first cover portion to said second cover portion, and at least three of said second interconnecting tabs connecting said second cover portion to said third cover portion, respectively.

4. The arrangement as claimed in claim 3, wherein there are four of said first interconnecting tabs generally equispaced about said second opening and there are four of said second interconnecting tabs generally equispaced about said first opening.

5. The arrangement as claimed in claim 4, wherein said first interconnecting tabs are spaced about the periphery of said second opening so that said first tabs generally bisect said second interconnecting tabs spaced about the periphery of said first opening.

6. The arrangement as claimed in claim 1, wherein said first and said second openings are each formed by a plurality of separate cuts defined along the respective peripheries of said openings in the paperboard member, the number of said separate cuts for each said opening corresponding to the respective number of said first and said second interconnecting tabs spanning said second and said first openings, respectively.

7. The arrangement as claimed in claim 6, wherein each of said separate cuts lies substantially along the periphery of the respective one of said openings said cut at least partially defines each said cut having a first end extending outwardly of said openings and a spaced second end extending inwardly of said openings, the first end of one of said cuts overlapping and being spaced from the second end of an adjacent one of said cuts so as to define said first and said second interconnecting tabs, respectively.

8. The arrangement as claimed in claim 1, wherein said paperboard member includes a plurality of said pairs of openings for separating a plurality of the pairs of cans therewith.

9. The arrangement as claimed claim 1, wherein said first and said second openings defined in the paperboard member are each generally circular.

10. The arrangement as claimed in claim 1, wherein said paperboard member further comprises at least one recess defined in an edge thereof for engagement with an indexing and positioning mechanism formed as a part of a packing line along which said paperboard member is moved.

11. A method of separating a pair of cans stacked for storage one on top of the other, the pair of cans having a lower can and a stacked upper can, each can having a base rim and a spaced top rim projecting above a recessed top panel of the can, the top panel incorporating an integral can opening device, said method comprising the steps of:

providing a paperboard member for being positioned between the lower can and the upper can;

forming a pair of concentric openings in said paperboard member, said pair of openings comprising a first outer opening and a second inner opening;

sizing said first outer opening to be marginally smaller than the top rim of the lower can;

sizing said second inner opening to span the can opening device in the recessed top panel of the lower can;

said second opening defining a first cover portion extending inwardly of the periphery of said second opening in said paperboard member for extending over the can opening device of the lower can;

defining a second cover portion in said paperboard member between said first and said second openings;

defining a third cover portion in said paperboard member, said third cover portion extending outwardly of the periphery of said first outer opening;

connecting said first cover portion to said second cover portion with at least one first interconnecting tab;

connecting said second cover portion to said third cover portion by at least one second interconnecting tab; and positioning said paperboard member between the lower can and the upper can, separating the lower can from the upper can with said paperboard member, and moving said cover portions into different planes with respect to one another in response thereto.

12. A separating arrangement for separating a pair of cans stacked one on top of the other, the pair of cans having a lower can and a stacked upper can, each can having a base rim and a spaced and generally parallel top rim projecting beyond a recessed top panel of the can, the top panel incorporating an integral can opening device, said arrangement comprising:

a paperboard member for being positioned between the lower can and the upper can;

a first cover portion defined in said paperboard member, said first cover portion being sized and shaped to span the can opening device in the recessed top panel of the lower can;

a second cover portion defined in said paperboard member along the periphery of said first cover member, said second cover portion extending away from said first cover portion and being sized and shaped to be marginally smaller than the top rim of the lower can;

a third cover portion defined in said paperboard member along an outer periphery of said second cover portion, said third cover portion extending away from said second cover portion;

wherein said first cover portion is connected to said second cover portion by at least one first interconnecting tab, and said second cover portion is connected to said third cover portion by at least one second interconnecting tab, said at least one first and second interconnecting tabs being constructed and arranged to allow said cover portions to move into different planes with respect to one another.

* * * * *